US012185859B2

(12) United States Patent
Quatraro et al.

(10) Patent No.: US 12,185,859 B2
(45) Date of Patent: Jan. 7, 2025

(54) CURTAIN ROD SUSPENSION SYSTEM AND ASSEMBLY

(71) Applicant: Unique Fine Fabrics Import Inc., Woodbridge (CA)

(72) Inventors: Ralph Quatraro, Woodbridge (CA); Paul Mazzotta, Woodbridge (CA)

(73) Assignee: Unique Fine Fabrics Import Inc., Woodbridge (CA)

( * ) Notice: Subject to any disclaimer, the term of this patent is extended or adjusted under 35 U.S.C. 154(b) by 500 days.

(21) Appl. No.: 17/594,698

(22) PCT Filed: Apr. 27, 2020

(86) PCT No.: PCT/CA2020/050550

§ 371 (c)(1),
(2) Date: Oct. 26, 2021

(87) PCT Pub. No.: WO2020/215166

PCT Pub. Date: Oct. 29, 2020

(65) Prior Publication Data

US 2022/0202226 A1 Jun. 30, 2022

Related U.S. Application Data

(60) Provisional application No. 62/839,472, filed on Apr. 26, 2019.

(51) Int. Cl.

| | |
|---|---|
| ***A47H 1/124*** | (2006.01) |
| ***A47H 1/04*** | (2006.01) |
| ***A47H 1/144*** | (2006.01) |

(52) U.S. Cl.

CPC ..... *A47H 1/124* (2013.01); *A47H 1/04* (2013.01); *A47H 1/144* (2013.01); *A47H 2001/042* (2013.01); *A47H 2001/045* (2013.01)

(58) Field of Classification Search

CPC ..... A47H 1/12; A47H 1/122; A47H 1/124; A47H 1/13; A47H 1/04; A47H 1/14; A47H 1/144

See application file for complete search history.

(56) References Cited

U.S. PATENT DOCUMENTS 745,426 A * 12/1903 Ebert ..... A47H 1/13 248/260
793,899 A * 7/1905 Nelson ..... A47H 1/13 248/254

(Continued)

FOREIGN PATENT DOCUMENTS

| | | |
|---|---|---|
| CN | 208740605 U | 4/2019 |
| DE | 202005009381 U1 | 11/2006 |
| DE | 202011001159 U1 | 5/2011 |

OTHER PUBLICATIONS

First Office Action issued in Chinese Patent Application No. 202080031515.1.

(Continued)

*Primary Examiner* — Johnnie A. Shablack
(74) *Attorney, Agent, or Firm* — CPST Intellectual Property Inc.; Santosh K. Chari

(57) ABSTRACT

A suspension system for curtain rods a wall plate for securing to a wall and a car slidably received therein for adjusting the position thereof with respect to the wall plate. A curtain rod comprises a first and second channels, one channel including a hook portion for engaging a cooperating hook portion of a clip mounted directly or indirectly to a wall or ceiling.

14 Claims, 16 Drawing Sheets

(56) References Cited

U.S. PATENT DOCUMENTS 978,095 A * 12/1910 Willet ..... A47H 1/13 248/256
1,354,917 A * 10/1920 Pys ..... A47H 1/13 248/259
1,388,643 A * 8/1921 Hellmuth ..... E06B 9/42 160/110
1,499,340 A * 7/1924 Bundy, Jr. ..... E06B 9/50 248/269
1,507,649 A * 9/1924 Wonsowicz ..... A47H 1/13 248/256
2,013,500 A 9/1935 O'Connor
2,050,507 A * 8/1936 Stracka ..... A47H 1/122 248/265
2,056,874 A * 10/1936 Updegraff ..... A47H 1/122 248/265
2,341,217 A 2/1944 Holtzclaw
2,720,373 A * 10/1955 Bell ..... A47H 1/124 248/262
2,894,710 A * 7/1959 Shields ..... A47H 1/124 248/265
2,918,245 A * 12/1959 Cameron ..... A47H 1/124 248/263
2,985,907 A * 5/1961 Duncan ..... A47H 1/144 160/19
3,005,615 A * 10/1961 McKay ..... A47H 1/122 248/265
3,346,227 A 10/1967 Hankin
3,402,421 A * 9/1968 Weber ..... A47H 1/124 16/94 R
3,730,469 A * 5/1973 Shields ..... A47H 1/12 248/265
4,120,474 A 10/1978 Hurley
4,179,091 A * 12/1979 Bidney ..... A47H 1/144 248/265
4,381,578 A 5/1983 Glejf
4,406,436 A * 9/1983 Benthin ..... A47H 1/144 248/262
6,138,324 A * 10/2000 Lin ..... A47H 1/04 16/87.6 R
6,196,508 B1 3/2001 Nijs
D450,234 S 11/2001 Bosgoed
7,451,956 B2 * 11/2008 Bohlen ..... E06B 9/323 248/265
7,677,294 B2 * 3/2010 Bohlen ..... E06B 9/50 160/323.1
7,836,937 B2 * 11/2010 Anderson ..... E06B 9/34 160/242
7,854,419 B2 * 12/2010 Ng ..... E06B 9/50 248/257
8,016,016 B2 * 9/2011 Berman ..... E06B 9/50 160/242
8,122,932 B2 * 2/2012 Cannaverde ..... E06B 9/50 248/265
8,157,231 B2 * 4/2012 Shiu ..... G02B 27/283 242/598.5
8,220,520 B2 * 7/2012 Lukos ..... G03B 21/58 160/242
8,960,621 B2 * 2/2015 Wills ..... E06B 9/174 160/19
8,967,568 B2 * 3/2015 Wills ..... E06B 9/50 248/269
9,206,641 B2 * 12/2015 Feldstein ..... A47H 1/12
9,247,840 B2 * 2/2016 Diamond ..... E06B 9/42
9,347,261 B2 * 5/2016 Blair ..... E06B 9/42
9,677,705 B2 * 6/2017 Cen ..... F16M 13/02
10,214,960 B2 * 2/2019 Ng ..... E06B 9/50
11,178,991 B2 * 11/2021 Dobin ..... A47H 1/06
11,965,380 B2 * 4/2024 Enochs ..... E06B 9/50
2005/0183835 A1 * 8/2005 Nien ..... E06B 9/50 160/321
2007/0120031 A1 * 5/2007 Rasmussen ..... E06B 9/50 248/266
2008/0135191 A1 * 6/2008 Zakowski ..... E06B 9/50 160/368.1
2019/0024452 A1 * 1/2019 Derk, Jr. ..... E06B 9/42
2020/0245801 A1 * 8/2020 Hsu ..... A47H 1/022
2020/0300034 A1 * 9/2020 Hopkins ..... E06B 9/42

OTHER PUBLICATIONS

International Search Report of Aug. 18, 2020, issued in PCT/CA2020/050550.
Forest Drapery Hardware brochure—DS Design System, 2016.
Partial Search Report issued in European Patent Application No. 20794113.9, dated Apr. 12, 2023.

* cited by examiner

CURTAIN ROD SUSPENSION SYSTEM AND ASSEMBLY

CROSS REFERENCE TO RELATED APPLICATIONS

This application is a National Entry of PCT Application No. PCT/CA2020/050550, filed on Apr. 27, 2020, which claims priority to U.S. Application No. 62/839,472, filed Apr. 26, 2019. The entire contents of such prior applications are incorporated herein by reference.

FIELD OF THE DESCRIPTION

The following description generally relates to wall and/or ceiling mounted suspension systems for curtains and the like.

BACKGROUND

Ripple fold curtain suspension systems typically comprise mounting brackets and one or more channel rods.

Conventional channel rods, which are also known as traverse support rods, comprise channels formed by extruded material having a substantially U-shaped cross-section. These U-shaped channels comprise tracks in which curtain track carriers can slide. The lower portion of each curtain track carrier can be connected to fabric along the top of a curtain. Ceiling or wall mount channel brackets having clips designed to attach to the top of U-shaped channel rods are typically used to support such channel rods.

Although easily installed, such suspension systems can be considered aesthetically unappealing if the U-shaped channels and brackets are visible. Attempts have therefore been made to develop channel rods and/or brackets having an improved appearance, some of which are discussed below.

A known, commercially available suspension assembly implements a channel rod having an "H" type channel, shown in FIG. 9 ("Prior Art"). This "H" type channel is substantially concealed between two convex surfaces, thereby providing the channel rod with a tubular appearance. The top portion of this "H-type" channel, or its mounting channel, is attached to a specific bracket via the insertion of a channel bolt. Another common channel rod design comprises top and side channels that are also attached to wall and roof plates via channel bolts. It is recognized that fastening such channel rods to brackets via the insertion of channel bolts can be difficult.

US Design Pat. No. D450,234 discloses a channel rod comprising a substantially semicircular portion extending from the base of a U-shaped extrusion. A support clip adapted to clamp the U-shaped extrusion from above is commonly used to support this channel rod. However, the semicircular portion includes a free, unsupported end which can be unstable.

Another difficulty with known curtain rod systems involves adjustments once the curtain rod is installed, particularly after the curtain is mounted. In this regard, curtain rods are generally mounted using a series of mounting assemblies or brackets that are attached to a wall or a ceiling. Once the curtain is hung, it is not uncommon that the weight of the curtain results in some movement of the supporting bracket resulting in the curtain being unevenly hung. Adjusting the brackets involves removing from the wall or ceiling and reattachment, which is very time consuming. What is needed is an attachment assembly, in particular a wall attachment assembly, that allows for any necessary height adjustments.

In view of the foregoing, it is recognized that it is desirable to develop a curtain suspension system that addresses one or more of the above drawbacks.

SUMMARY OF THE DESCRIPTION

Described herein is an improved wall mounting assembly for securing a curtain rod that allows for adjustment of the positioning of the supporting portion after the assembly is secured to a wall. Also described herein is an improved curtain rod support system incorporating such assembly.

The description further provides an improved curtain rod for attachment to a cooperating clip.

Thus, in one aspect, there is provided a wall mount assembly for a curtain suspension system, the wall mount assembly comprising:

- a wall plate, adapted to be secured to a wall, and having a track defined by two opposed walls and a base, the track having a longitudinal axis;
- an adjusting pin having a threaded first portion and a second portion, the second portion extending through the base, the adjusting pin having a longitudinal axis generally parallel to the longitudinal axis of the track and wherein the adjusting pin is rotatable about its longitudinal axis with respect to the wall plate; and,
- a car adapted to be slidably received in the track, the car having a threaded aperture for receiving and cooperating with the threaded first portion of the adjusting pin, the car further comprising a means for engaging a component of the curtain suspension system.

In another aspect, there is provided a curtain suspension system comprising: a wall mount assembly as defined above; and a support means comprising a first end, for connecting to the car of the wall mount assembly, and a second end, for connecting to a curtain support rod.

In another aspect, there is provided a curtain suspension system comprising:

a curtain rod comprising a generally elongate hollow body having a front face, a rear face, and a bottom surface, wherein:

- the front face comprises a façade;
- the rear face comprises a first longitudinally extending channel defining a first hook and a longitudinally extending flange;
- the bottom surface comprises second longitudinally channel adapted to slidably receive curtain suspension hooks;
- a clip adapted to be secured to a retaining means and having a connecting end for connecting to the curtain rod, the connecting end including a second hook and a recess;
- whereby, when in use, the second hook of the clip engages the first hook of the curtain rod and the flange of the curtain rod is received within the recess of the clip.

BRIEF DESCRIPTION OF THE FIGURES

The features of certain embodiments will become more apparent in the following detailed description in which reference is made to the appended figures wherein.

DETAILED DESCRIPTION

Figure 9:
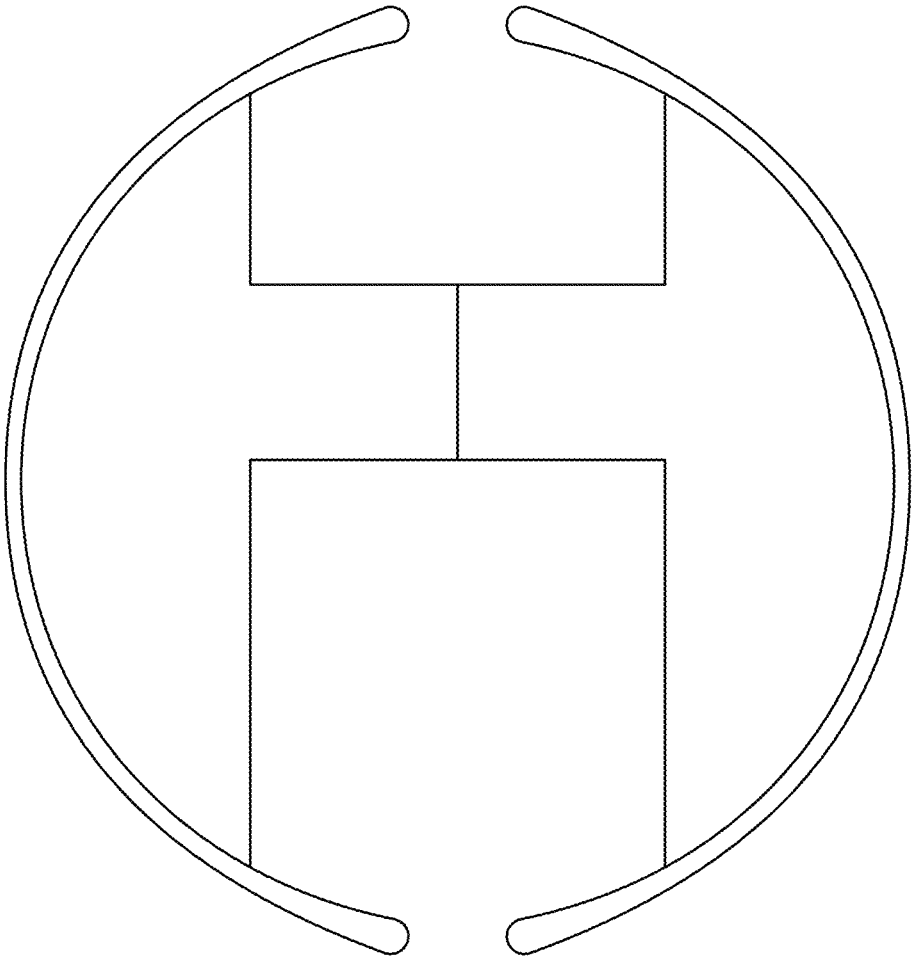
FIG. 9 (Prior Art)
FIG. 9 depicts a prior art "H"-type channel rod.

Provided herein is a suspension system for curtains such as ripple fold curtains. The system includes a new channel rod design that includes a hooking extension adapted to be stabilized by a hooking portion of a new bracket clip. The extension is therefore provided with greater stability as compared to the extension included in the channel rod of the '234 Design Patent. It will be understood by those skilled in the art that attaching the new channel rod to the bracket clips provided herein is easier than attaching the prior art rod (FIG. 9) to a bracket using channel bolts.

One of the bracket clip designs of the present disclosure is adapted to attach to a wall bracket, and the other is part of a ceiling bracket. The wall bracket can be vertically adjusted after the suspension assembly has been mounted to a wall. This can be particularly useful in achieving a consistent height of the bottom of the curtain along the length of the wall without having to completely remove and replace the wall brackets.

The terms "comprise", "comprises", "comprised" or "comprising" may be used in the present description. As used herein (including the specification and/or the claims), these terms are to be interpreted as specifying the presence of the stated features, integers, steps or components, but not as precluding the presence of one or more other feature, integer, step, component or a group thereof as would be apparent to persons having ordinary skill in the relevant art. Thus, the term "comprising" as used in this specification means "consisting at least in part of". When interpreting statements in this specification that include the term "comprising", the features, prefaced by that term in each statement, all need to be present but other features can also be present. Related terms such as "comprise" and "comprised" are to be interpreted in the same manner.

The term "and/or" can mean "and" or "or".

One or more of the terms "vertical", "vertically", "horizontal", "horizontally", "top", "bottom", "upwardly" and "downwardly" are used throughout this specification. It will be understood that these terms are not intended to be limiting. These terms are used for convenience and to aid in describing the features herein.

Figure 1A:
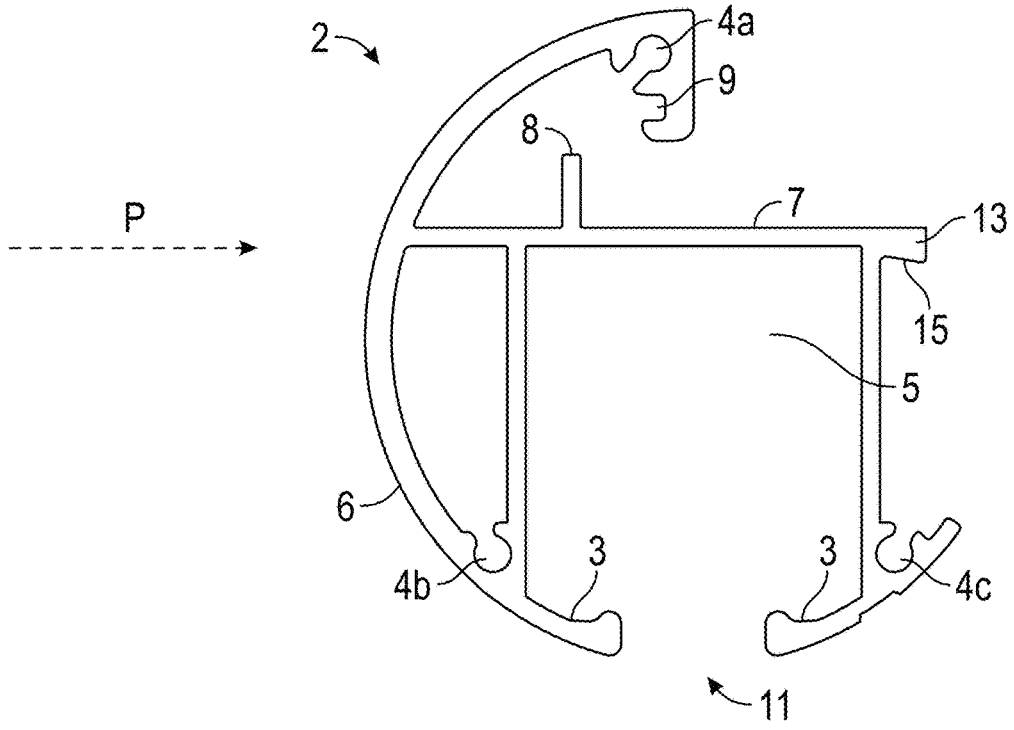
FIG. 1A depicts a right-side view of a channel rod extrusion.
Figure 1B:
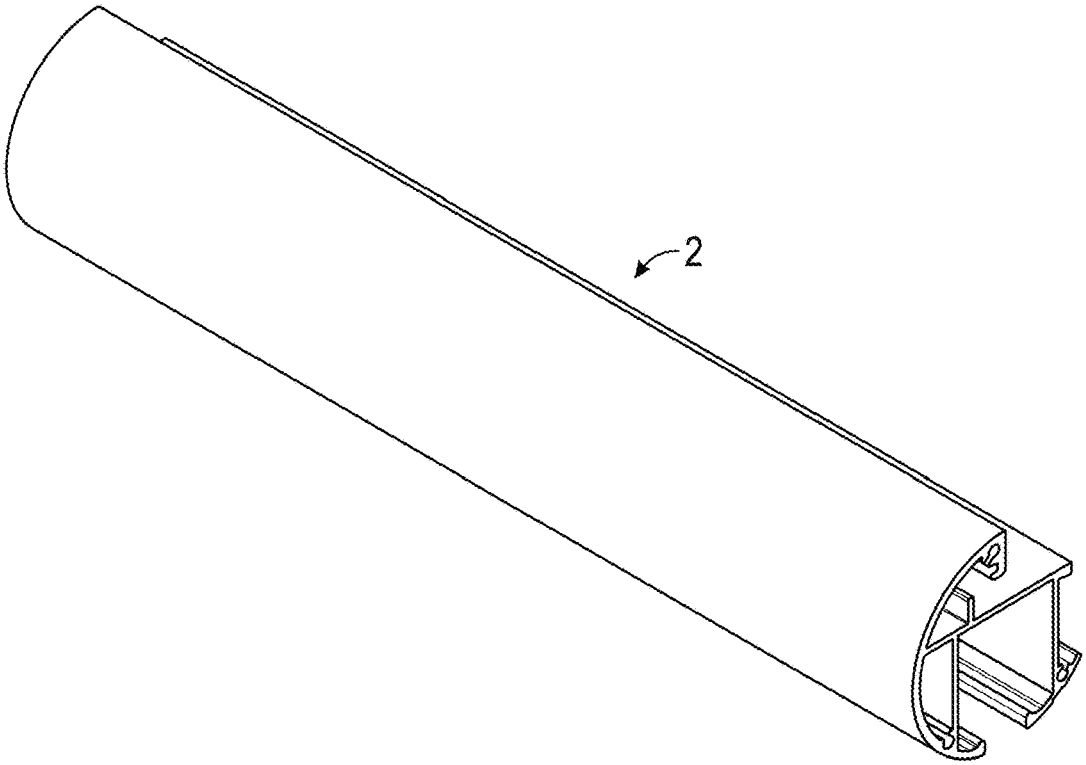
FIG. 1B depicts a perspective view of the channel rod extrusion.
Figure 2A:
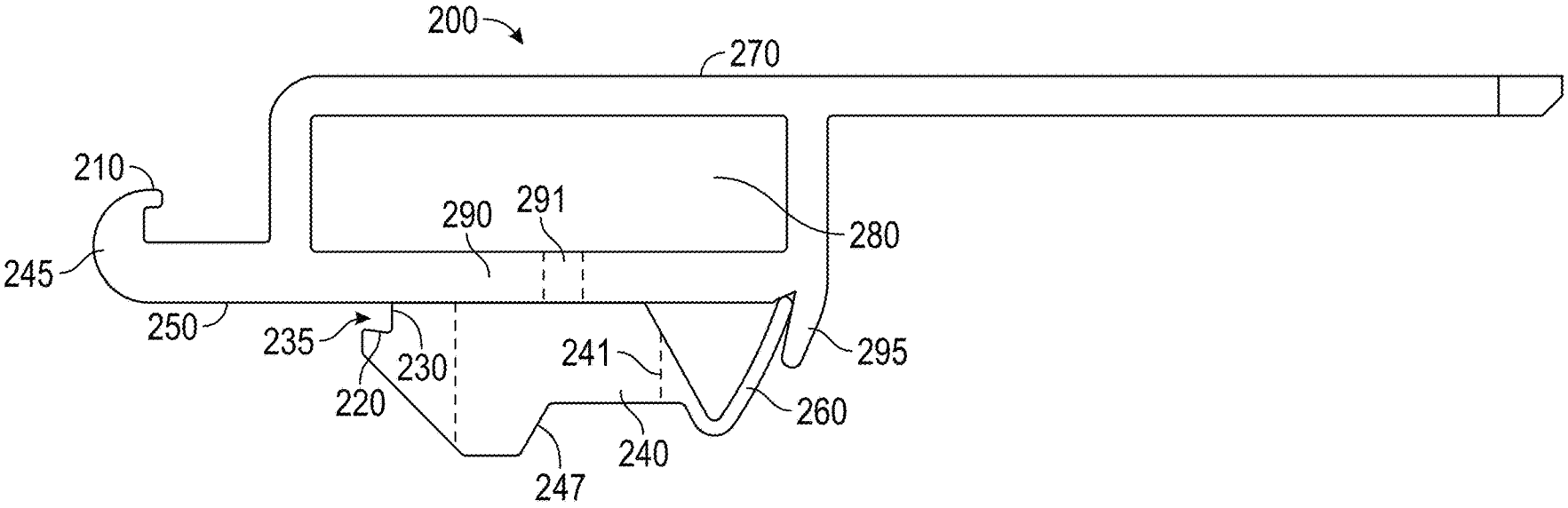
FIG. 2A depicts a right-side view of a ceiling mount for the channel rod extrusion.
Figure 2B:
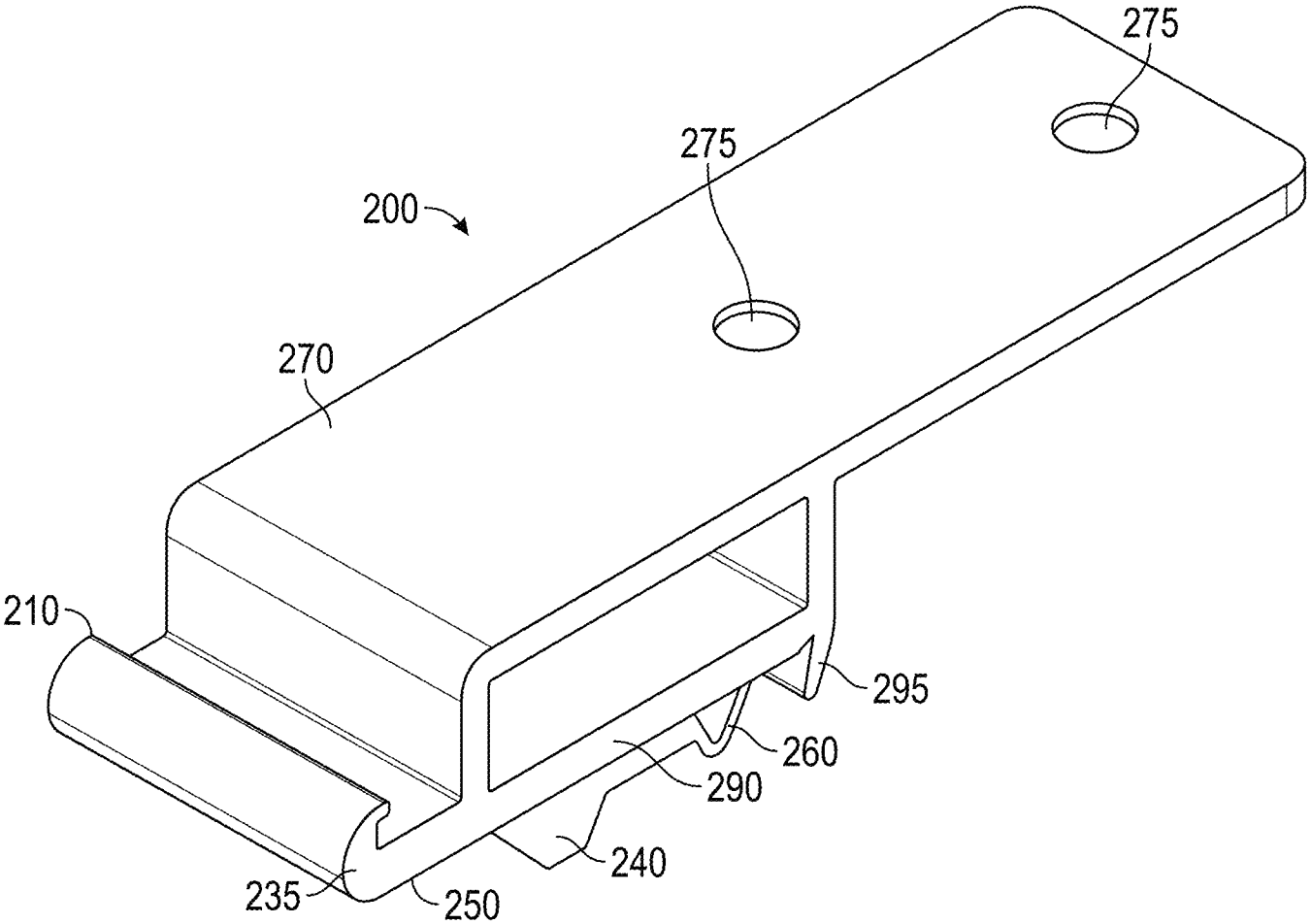
FIG. 2B depicts a perspective view of a ceiling mount for the channel rod extrusion.

Turning to the figures, FIG. 1A depicts a channel rod 2 according to one aspect and FIGS. 2A and 2B depict a mounting bracket 200 for supporting the channel rod 2 when in use. As shown in FIG. 1A, the channel rod 2 includes a substantially U-shaped channel 5 that opens downward (i.e. towards the floor) when installed. The channel rod 2 also comprises a façade, or external cover portion 6 on a front end thereof, which serves to provide the channel rod 2 with a desired aesthetic appearance when viewed in the general direction of perspective line P. In one aspect, the cover portion 6 may have a curved appearance, as shown in FIGS. 1A and 1B to make the channel rod 2 appear to have a tubular appearance. In another aspect, the cover portion 6 may have a square or triangular shape to result in the channel rod 2 having a different aesthetic appearance. It will thus be understood that the cover portion 6 described herein may have any aesthetic shape.

Generally, and as commonly known in the art, the channel rod 2 may be formed as an extrusion so as to be provided as a unitary structure. Such extrusion may be of any known material.

Figure 6A:
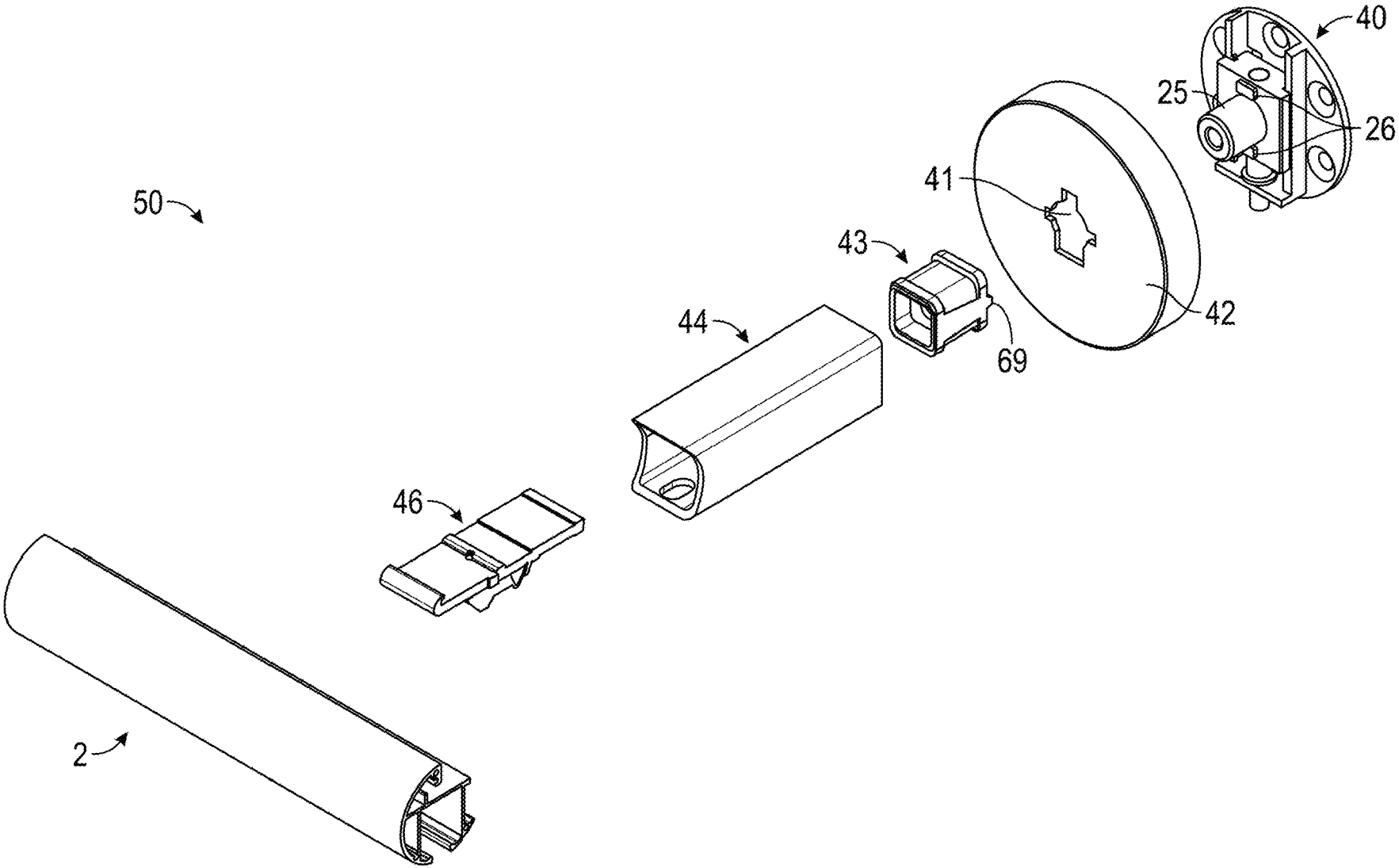
FIG. 6A depicts an exploded view of a wall-mounted suspension system for curtains.
Figure 6B:
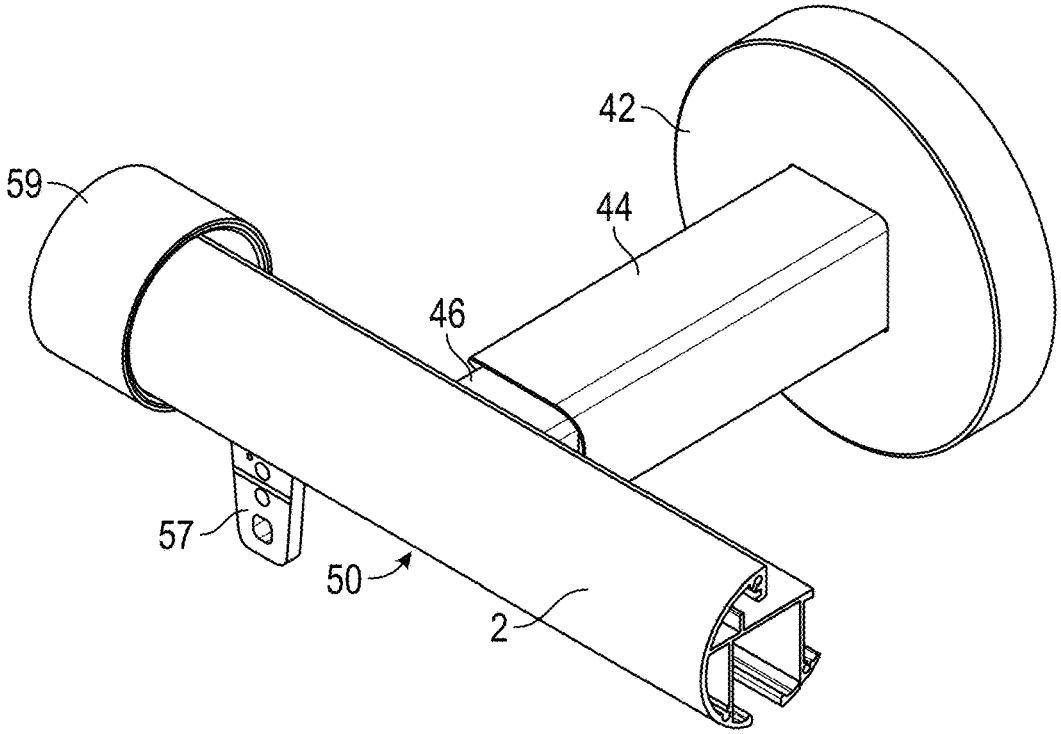
FIG. 6B depicts a perspective view of the wall-mounted suspension system.
Figure 6C:
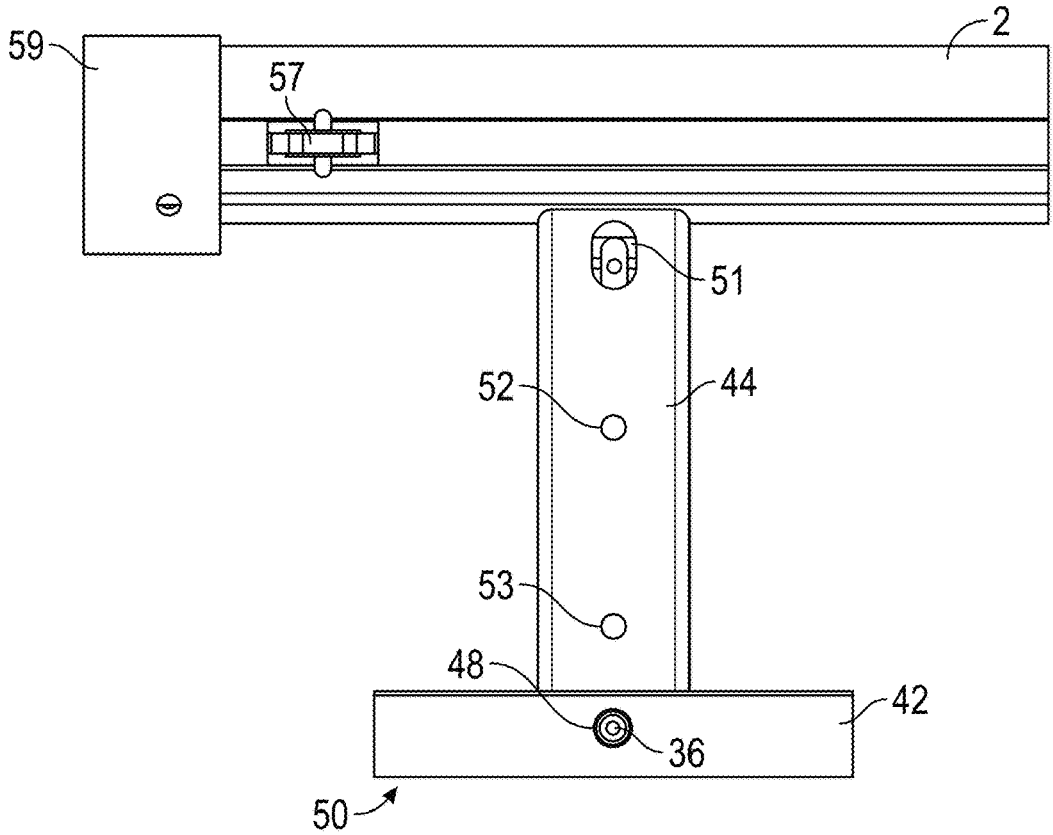
FIG. 6C depicts a top view of the wall-mounted suspension system.
Figure 6D:
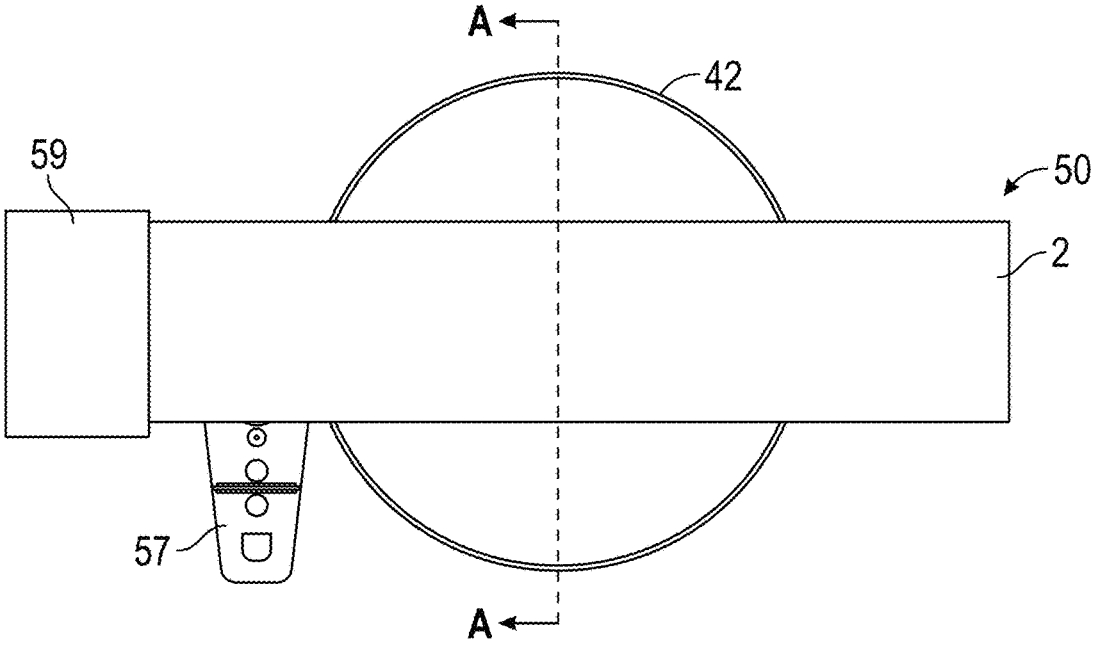
FIG. 6D depicts a front view of the wall-mounted suspension system.

The open end of the U-shaped channel 5 comprises a track 11 formed by opposed rails 3. The track 11 is adapted to slidably receive and support curtain track carriers (such as shown at 57 in FIGS. 6B-6E). As known in the art, such carriers typically include fasteners or hooks from which a curtain or the like may be suspended. The channel rod 2 further comprises a hook slot 9 and an inner engagement protrusion 13. Hook slot 9 is adapted to engage a hooked end 210 of the support hook 245 of the mounting bracket 200, as shown in FIG. 2A, when the rod and bracket are engaged, or connected together. To further assist the engagement between the channel rod 2 and mounting bracket 200, the engagement protrusion 13 or the channel rod 2 is adapted to fit into a slot 235 in clamping portion 240 of the mounting bracket 200. The engagement between the channel rod 2 and the mounting bracket 200 is illustrated in FIG. 6A and FIG. 7.

In one aspect, the bottom surface 220 or the slot 235 and the bottom surface 15 of the engagement protrusion 13 can be parallel with respect to the floor and/or ceiling, when in use. In another aspect, the bottom surfaces may be provided in an angular relationship so as to form a positive engagement to aid in preventing the channel rod 2 from moving away from the mounting bracket 200. Such an arrangement is shown in FIGS. 1A and 2A. As can be seen, the bottom surfaces 220 and 15 are correspondingly angled or slanted so that, when the rod 2 and mounting bracket 200 are engaged, the protrusion 13 (and thereby the rod 2) is urged into the slot 235. As will be understood, such an arrangement would be preferred so that, when mounted, the rod 2 and bracket 200 are maintained in engagement.

Figure 7:
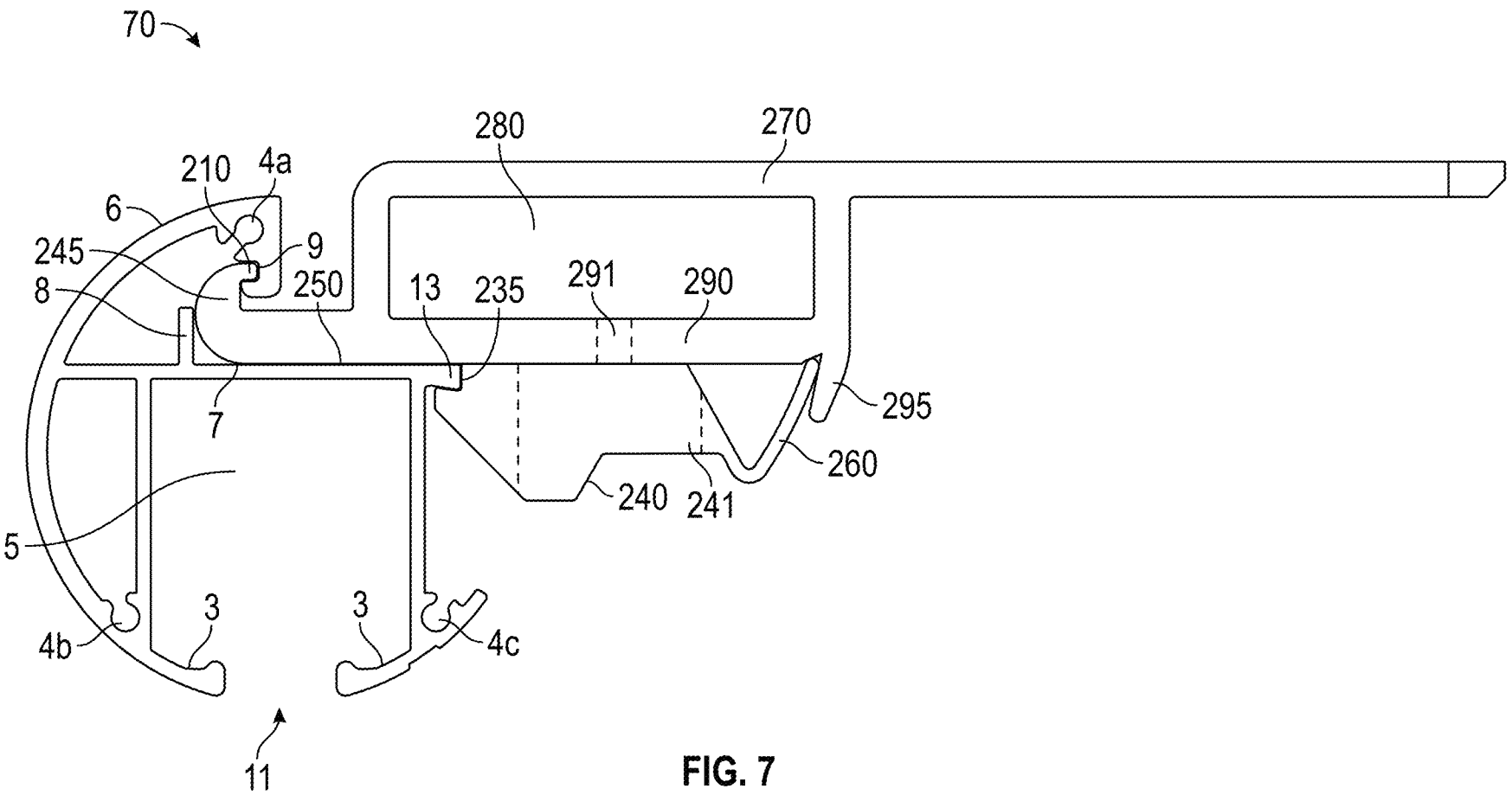
FIG. 7 depicts a side view of a ceiling-mounted suspension system.

Turning to FIG. 7, a ceiling-mounted suspension assembly 70 is depicted wherein mounting bracket 200 and channel rod 2 are shown in an engaged arrangement, such as would be when in use. As discussed below, flange 270 of the mounting bracket 200 is adapted to be affixed to a ceiling. It will be understood that in a typical installation, a number of mounting brackets would used, the number being dependent upon, inter alia, the desired span of the channel rod 2 and/or the weight of the curtain being suspended. Thereafter, the channel rod 2 is secured to the mounting brackets to form a suspension assembly 70.

In suspension assembly 70, bottom surface 250 of support hook 245 contacts top top surface 7 of the channel 5. As discussed above, for engaging the channel rod 2 to the mounting bracket 200 (i.e. after the brackets are secured to the ceiling), the rod 2 is manipulated to engage the hooked end 210 of the mounting bracket 200 into the hook slot 9 of the channel rod 2. In so doing, and as illustrated in FIG. 7, the channel rod 2 may preferably be provided with a backing surface, or stop 8, which limits the travel of the support hook 245. In this way, the end of the support hook 245 can aid in supporting or stabilizing the cover portion 6 while also providing support for the rod 2 and any curtains suspended therefrom. Support hook 245 is depicted as a curved hook; however, it will be understood that support hook 245 can be L-shaped, or shaped in any way that does not compromise its function. Since the hook 245 extends upwardly, the rod 2 can remain supported even when it is not fully clipped in (i.e. when engagement protrusion 13 is not secured in slot 235), which can facilitate adjustment of the rod as compared to the rod of the '234 Design Patent which must be clipped in to be supported.

Clamping portion 240 of the mounting bracket 200 comprises a biasing member 260 which abuts overhang 295. Overhang 295 biases member 260 towards the engagement protrusion 13, thereby biasing slot 235 against engagement protrusion 13. As shown in FIG. 2A, to further enhance this biasing effect, the overhang 295 may be provided at an angle sloping towards the member 260 so as to more securely engage such member. Clamping portion 240 and lower arm 290 comprise openings 241 and 291, respectively. A fastening means such as a screw can extend from opening 241 into opening 291, thereby fastening clamping portion 240 against lower arm 290 of the mounting bracket 200. In one aspect, the opening 241 may be of an elongate shape, so as to allow the clamping portion 240 to slide with respect to lower arm 290 so as to facilitate the installation process. The opening 291 is adapted to retain the fastening means in place with respect to the lower arm 290 as the clamping portion 240 travels. Once in the desired position, the clamping portion 240 can be secured to the lower arm 290 by tightening the screw.

The mounting bracket 200 can be attached to a ceiling by screwing upper surface 270 to the ceiling via one or more openings 275 illustrated in FIG. 2B. Preferably, two such opening are provided to ensure an adequate degree of securing force.

In another embodiment of the ceiling mount 200, overhang 295 and biasing member 260 are not included. In such case, the interaction between sloped surface 247 of the clamping portion and the fastening means (e.g. a screw) may be sufficient to urge the clamping portion toward engagement protrusion 13. In other words, as the fastening means is tightened, the interaction between such means and the sloped surface 247 would serve to urge the clamping portion 240 in a direction towards the channel rod 2. It will also be understood that both of the above-mentioned urging means (i.e. the biasing member 260 and the sloped surface 247) may be used together, as shown in the figures.

Continuing with FIG. 1A, channel rod 2 may optionally comprise linkage apertures 4*a*-4*c*, collectively referred to as apertures 4, which serve to allow axially adjacent channel rods together in an end-to-end manner. For establishing the connection, the apertures 4 may be provided with fastening means, such as screws or pins or the like (not shown). The ends of the fastening means are received within opposing apertures of the adjacent channel rods when the rods are urged together. As will be understood, such fastening means would aid in preventing separation of the adjacent connecting rods either in the axial and/or transverse directions. The fastening means may be reversibly or irreversibly connected to the respective apertures 4. As known in the art, end caps (not shown) are used to provide the ends of the channel rod 2 with a finished appearance. Where desired, the caps used with the rod described herein may be secured to the rod 2 by connecting with fastening means provided in the apertures. It will be understood that in such cases, the cap would also preferably include corresponding apertures or may be integrally formed with one or more fastening means that engage the apertures at the end of the rod 2.

Figure 4:
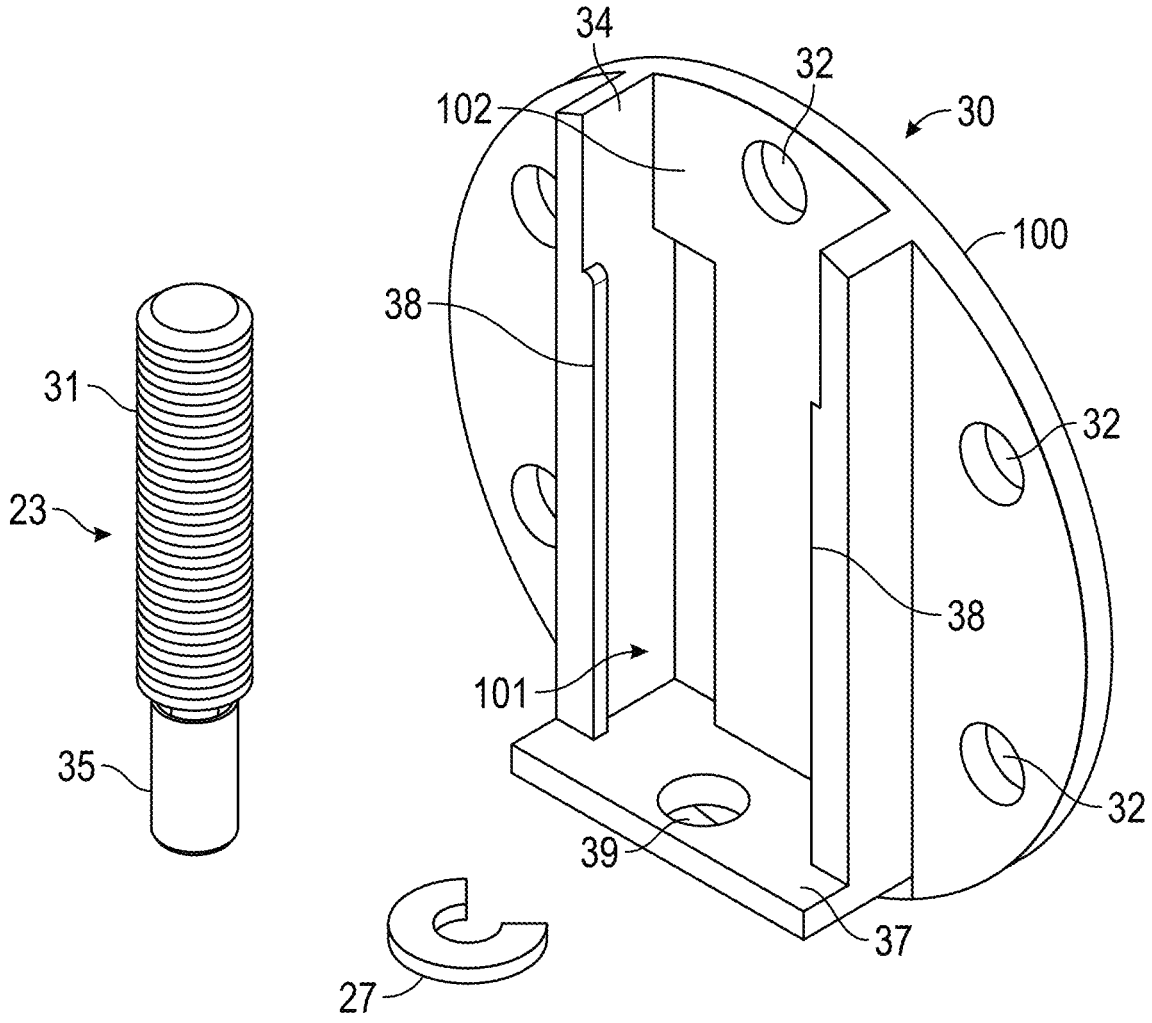
FIG. 4 depicts a perspective exploded view of a retaining pin adapted to be slidably received within an aperture in the car, a retaining washer, and a wall plate.

In the above discussion, reference has been made to a ceiling suspension system. The following discussion will relate to a wall mount system. FIG. 4 depicts a wall plate 30, with apertures 32, and a retaining pin 23. A retaining washer 27 may optionally be provided. Wall plate 30 comprises a first side 100 adapted for placement against any planar surface, such as a wall. The wall plate 30 comprises a second side 102 opposite the first side 100 and comprising a track 101 that is generally vertically oriented when in use. The track 101 is formed by a pair of opposed and spaced apart retaining walls 34 extending away from and generally perpendicular to the second side 102. The retaining walls 34 can, in one aspect, be positioned parallel to each other. Alternatively, the retaining walls 34 can also be arranged at an angle to each other such that the track 101 is provided with a generally wedge-shaped form. Retaining walls 34 further include flanges 38 extending from the ends of the retaining walls opposite to the second side 102. The flanges extend toward each other as shown in FIG. 4. As will be understood from the present description, the flanges 38 serve to partially close the track formed by the walls 34. Second side 102 further comprises a base 37 extending perpendicular to the second side 102 and extending between the retaining walls 34. The base 37 serves to generally close the bottom of the track 101 formed by the walls 34, as shown in FIG. 4.

Figure 3:
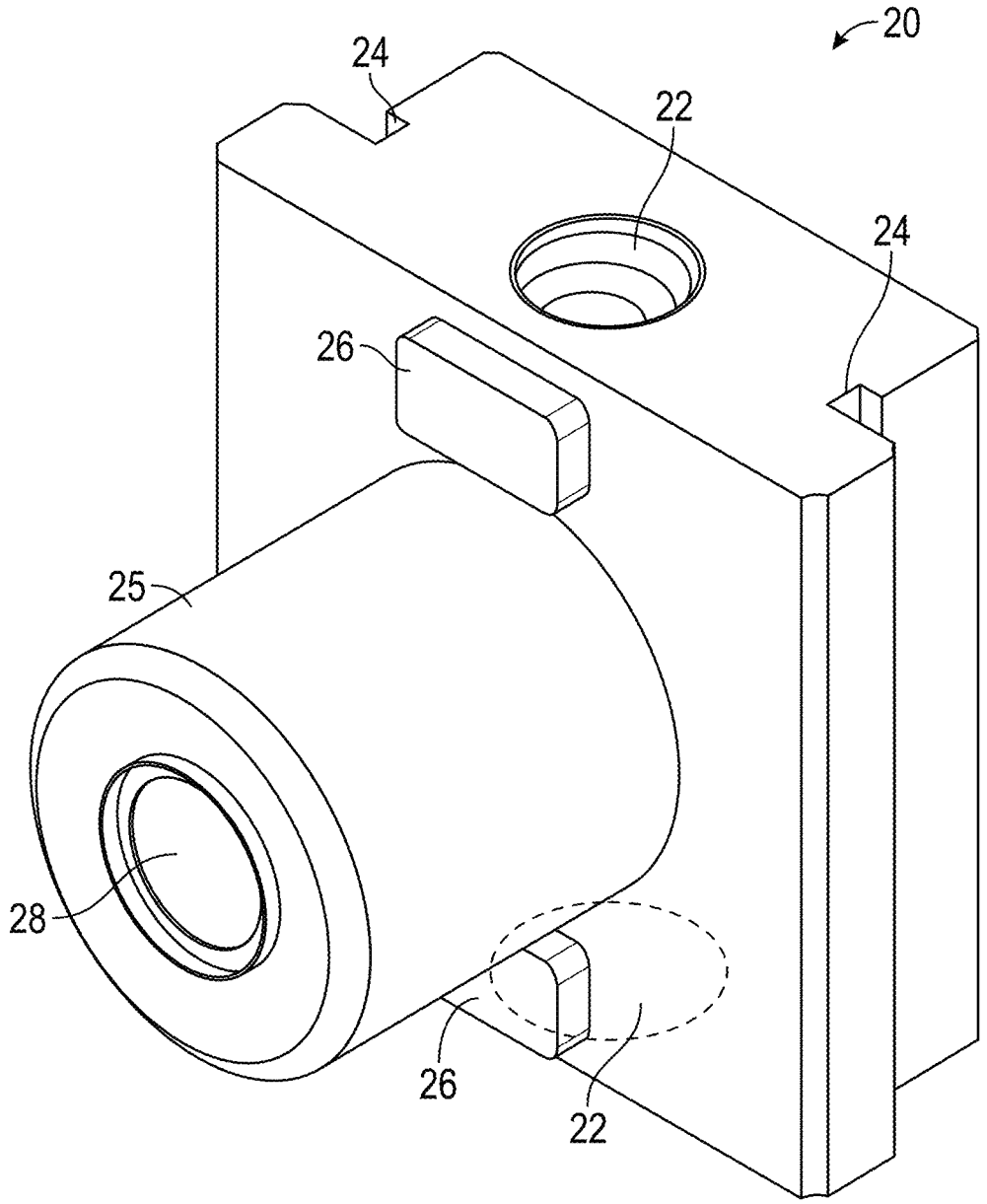
FIG. 3 depicts a perspective view of a car adapted to be slidably retained within a track.

The track 101 formed by the walls 34 and the base 37 is adapted to receive a car 20 as shown in FIG. 3. More specifically, while the car 20 (as discussed further below) is permitted to be slidably received within the track 101, its movement is restricted by the opposed walls 34, the flanges 38, and the base 37.

The base 37 comprises an opening or hole 39 which serves to position the retaining pin 23. Retaining pin 23 comprises a first, or upper, threaded portion 31, adapted to be received within a correspondingly threaded opening 22 in the car 20 (FIG. 3). The retaining pin 23 further comprises a second or lower end extension 35 adapted to extend through the hole 39. As will be understood, the diameter of the extension 35 is smaller than the diameter of threaded portion 31, whereby only the extension 35 of the pin 23 is permitted to pass through the opening 39. In a preferred aspect, a washer 27 or the like may be provided to aid in preventing the pin 23 from passing through the opening 39.

The extension 35 is also rotatably received within the opening 39. In one aspect, the end of the extension 35 is preferably adapted to receive a tool (such as a screwdriver, Allen key, wrench, or the like) that can be used to rotate the retaining pin 23 when received within the opening 39, as will be described below. As will also be understood, the washer 27 may also serve to facilitate rotation of the pin 23 when the extension 35 is received there-through and through the opening 39 (as shown in FIG. 5A).

FIG. 3. depicts the aforementioned car 20, which is adapted to be slidably received within the track 101 provided on the wall plate 30. In one aspect, the car 20 can be completely received within the track 101 provided in the wall plate 30. In another, preferred aspect, as shown in FIG. 3 and FIG. 5A, the car 20 comprises opposed grooves 24 for receiving the ends of the flanges 38 forming the track 101. As will be understood, in such arrangement, the car 20 is positively engaged with the track 101 and thereby with the wall plate 30. The body of the car 20 further includes a threaded opening 22 there-through for threadingly engaging the threaded portion 31 of the retaining pin 23.

The car 20 further includes a protrusion 25, which may be generally cylindrical in shape, and projections 26. Car 20 is discussed in greater detail with respect to FIGS. 5A-5D, which are described in more detail below.

Figure 5A:
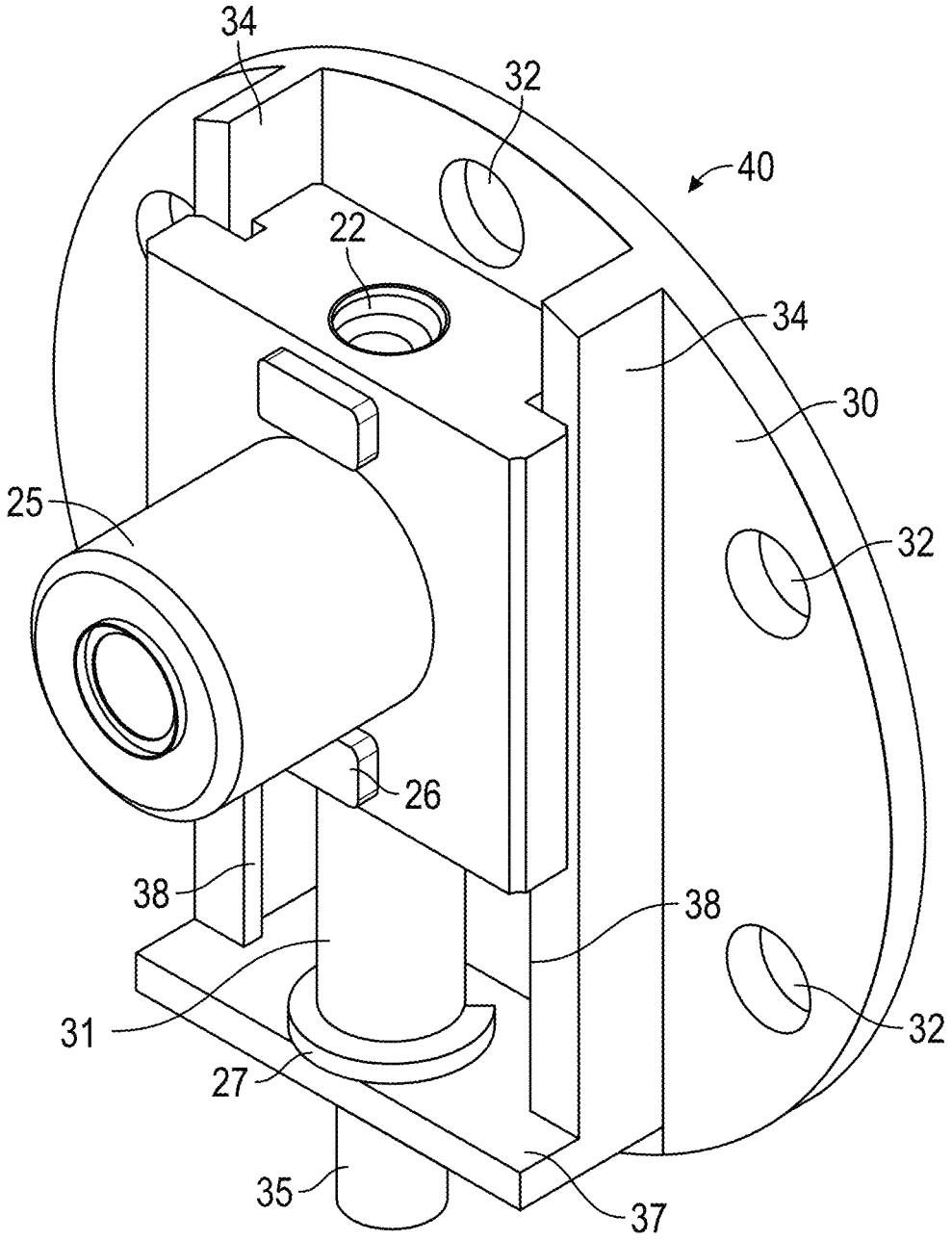
FIG. 5A depicts a perspective view of a vertically adjustable wall mount.
Figure 5B:
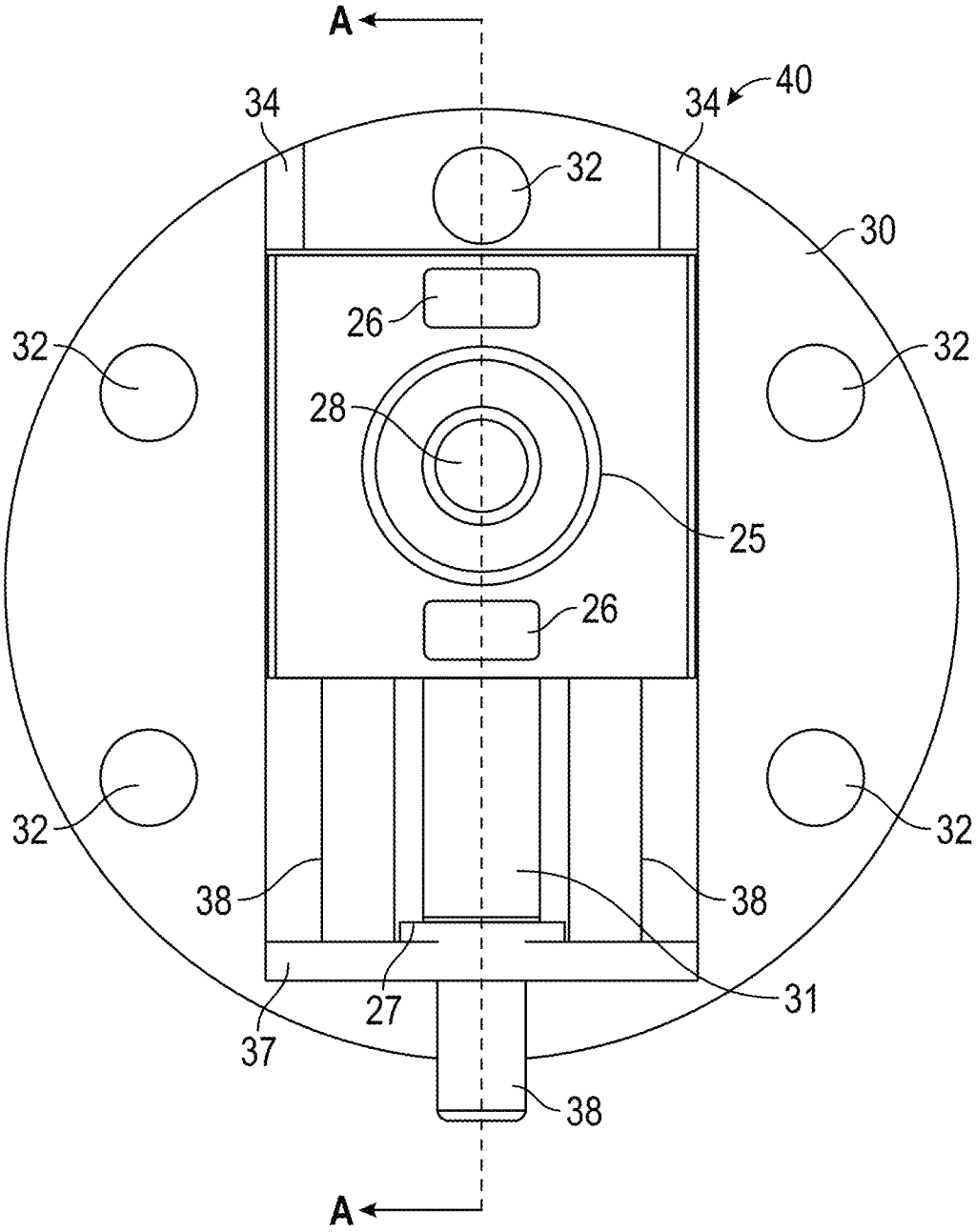
FIG. 5B depicts a front view of the vertically adjustable wall.
Figure 5C:
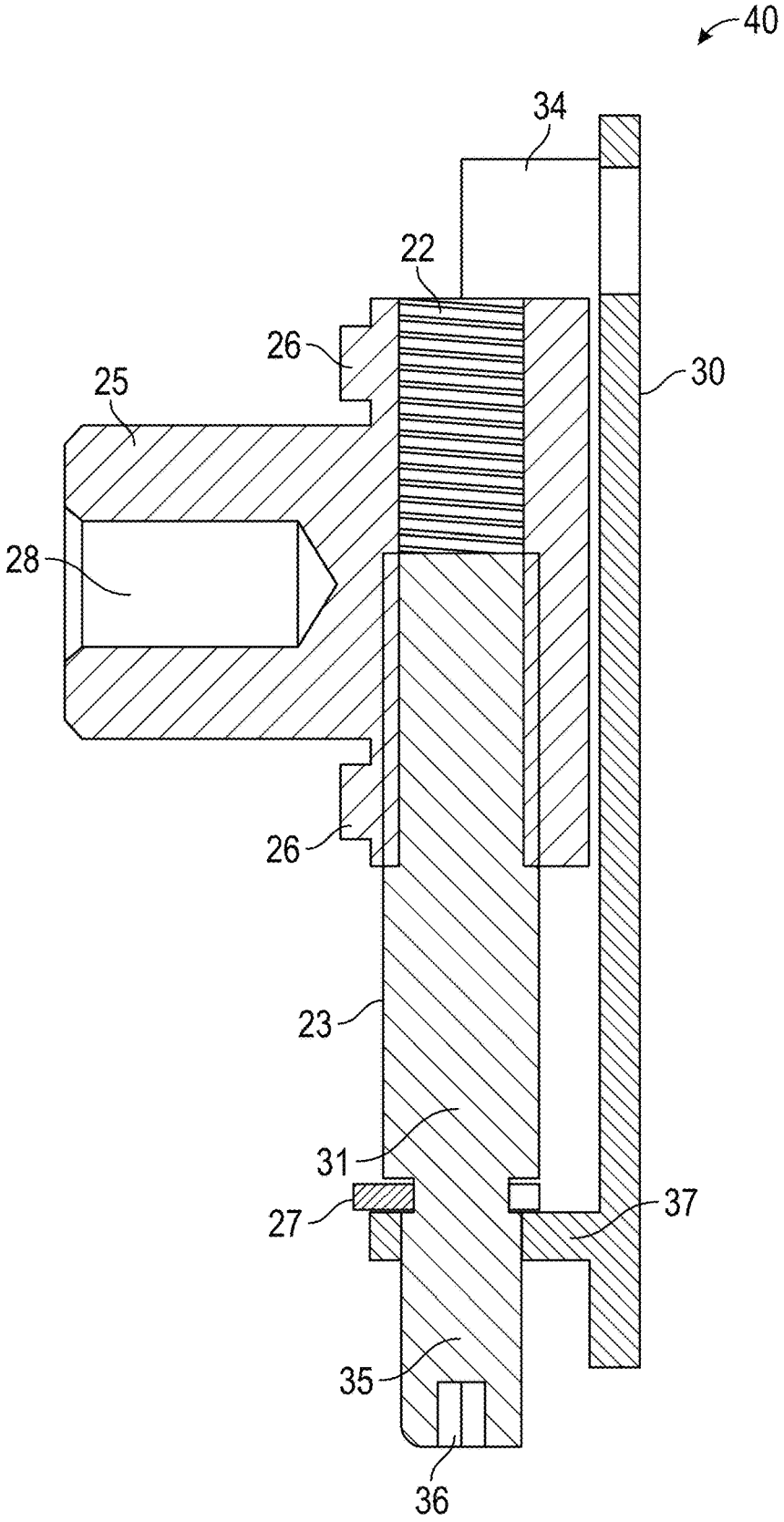
FIG. 5C depicts a cross-sectional view of the vertically adjustable wall mount taken along line A-A of FIG. 5B.

FIGS. 5A-5D illustrate a vertically adjustable wall mount assembly 40 according to one aspect. FIG. 5A is a perspective view of the wall mount assembly 40, which comprises a car 20, a wall plate 30, and a retaining pin 23, as described above. Turning to FIG. 5C, there is shown an opening 36 in extension 35, which is adapted to receive a tool which can impart rotational forces on the extension 35, thereby rotating retaining pin 23, as described above. As the retaining pin 23 rotates, the threading on threaded portion 31 translates the rotational force to the threading provided within aperture 22 of the car 20. Since the car 20 is constrained within the track 101, this force, in turn results in linear motion of car 20 within the track 101, toward or away from the base 37. The retaining pin 23 does not move vertically with respect to the base 37 since extension 35 is not threaded and spins freely within aperture 39. The car 20 can move vertically away from the base 37 within the limit provided by the retaining pin 23, and vertically toward the base 37 until it is stopped by the base 37. It will be understood that other means of limiting the movement of the car 20 may be included, such as further flanges, protrusions etc. within or associated with the track 101. For example, further flanges may be provided in the track to limit movement of the car 20 in a direction away from the base 37.

Figure 5D:
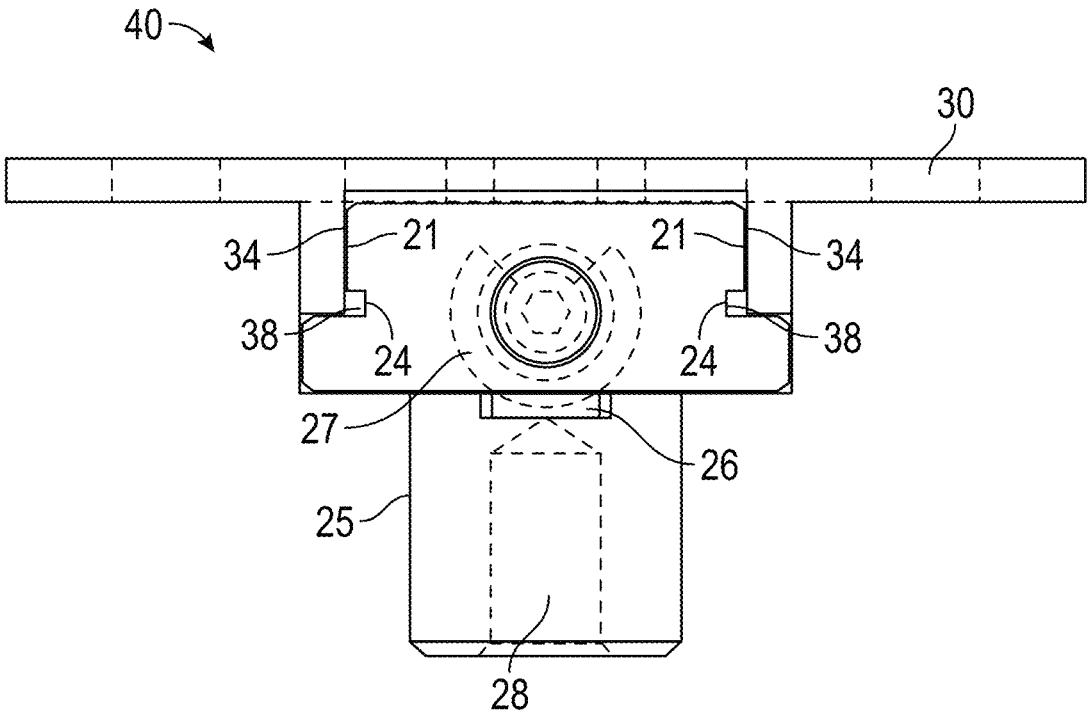
FIG. 5D depicts a top view of the vertically adjustable wall mount.

FIG. 5D illustrates the engagement between the grooves 24 of the car 20 and the flanges 38 of the track 101.

As will be understood, the ability vertically move the car 20 within the track 101 allows for the car 20 to be adjusted with respect to its vertical position after the assembly 40 is mounted to a wall.

FIGS. 6A-6E depict a wall-mounted suspension system 50 comprising the components described above. Turning to FIG. 6A, depicted is an exploded view of the wall-mounted suspension system 50 comprising vertically adjustable wall mount assembly 40, a faceplate 42 having an opening 41, a connecting member 43, a housing 44, a channel rod clip 46 (FIG. 8) and channel rod 2. The opening 41 is adapted to receive the protrusion 25 provided on the car 20 and may optionally also be adapted to positively engage projections 26 of car 20 and flanges 69 of connecting member 43. Although not necessary, the insertion of projections 26 and flanges 69 into opening 41 can help to prevent rotation of the components with respect to each other. Channel rod clip 46 and connecting member 43 are removably insertable into housing 44. Connecting member 43 can be held firmly in housing 44 by inserting a fastening means such as a screw through hole 53 (shown in FIG. 6E). Connecting member 43 includes an aperture that is adapted to receive protrusion 25 therein. In a preferred aspect, the protrusion 25 is secured in place once received within the aperture of the connecting member 43 using any type of fastening means, such as a screw, pin, etc.

Although housing 44 is depicted as being square or rectangular, the person skilled in the art will appreciate that housing 44 can be tubular or can have a number of other shapes.

FIGS. 6B-6E depict wall-mounted suspension system 50 in a fully assembled state, wherein the suspension system 50 further comprises an optional end cap 59 and a curtain track carrier 57. It can be appreciated that in the front view of FIG. 6D, only channel rod 2, faceplate 42, end cap 59 and part of track carrier 28 are visible. Channel rod 2 is adapted to slidably receive a plurality of curtain track carriers 57 in the conventional manner.

Figure 6E:
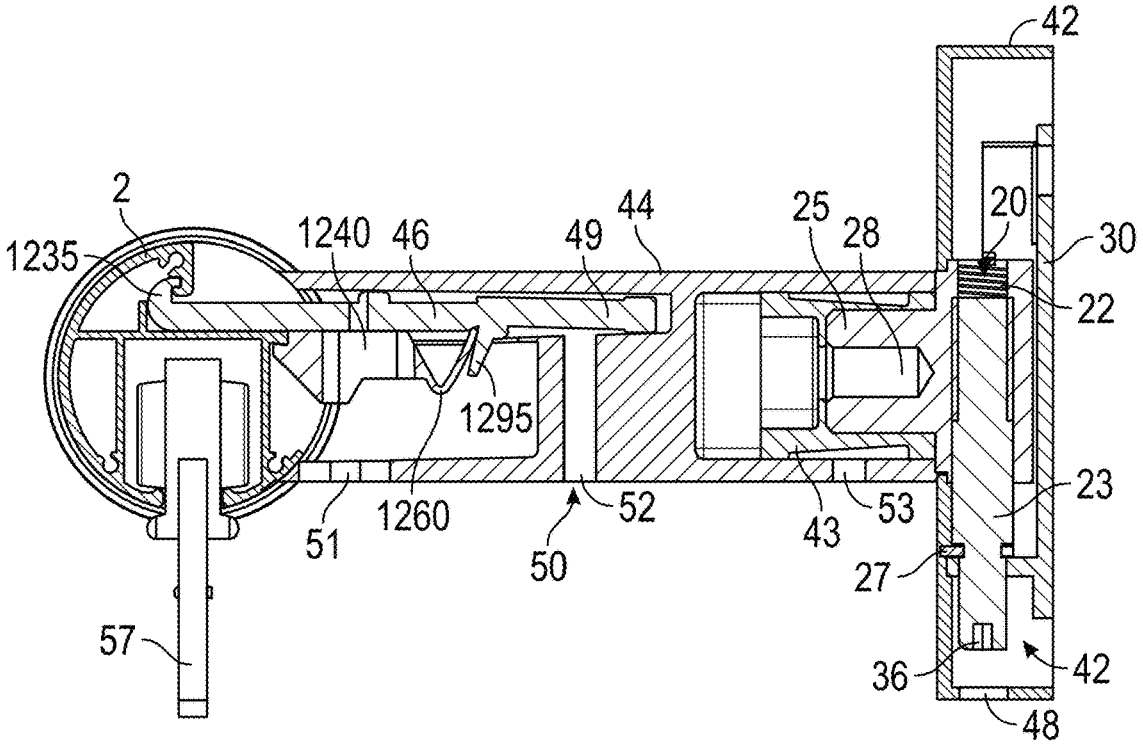
FIG. 6E depicts a cross-sectional view of the wall-mounted suspension system taken along line A-A of FIG. 6D.
Figure 8A:
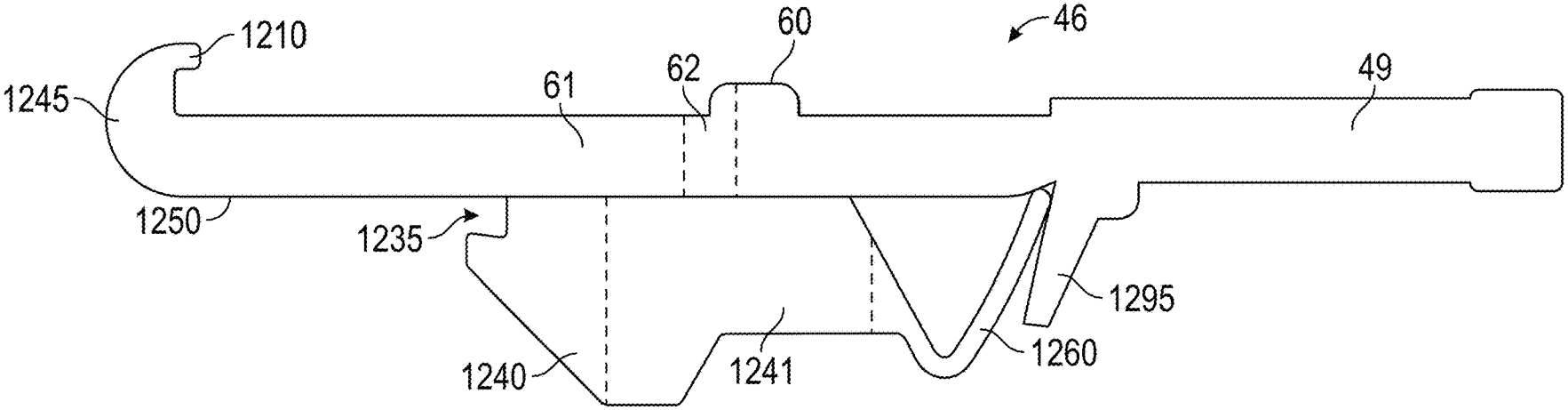
FIG. 8A depicts a side view of a bracket clip for the wall-mounted suspension system.
Figure 8B:
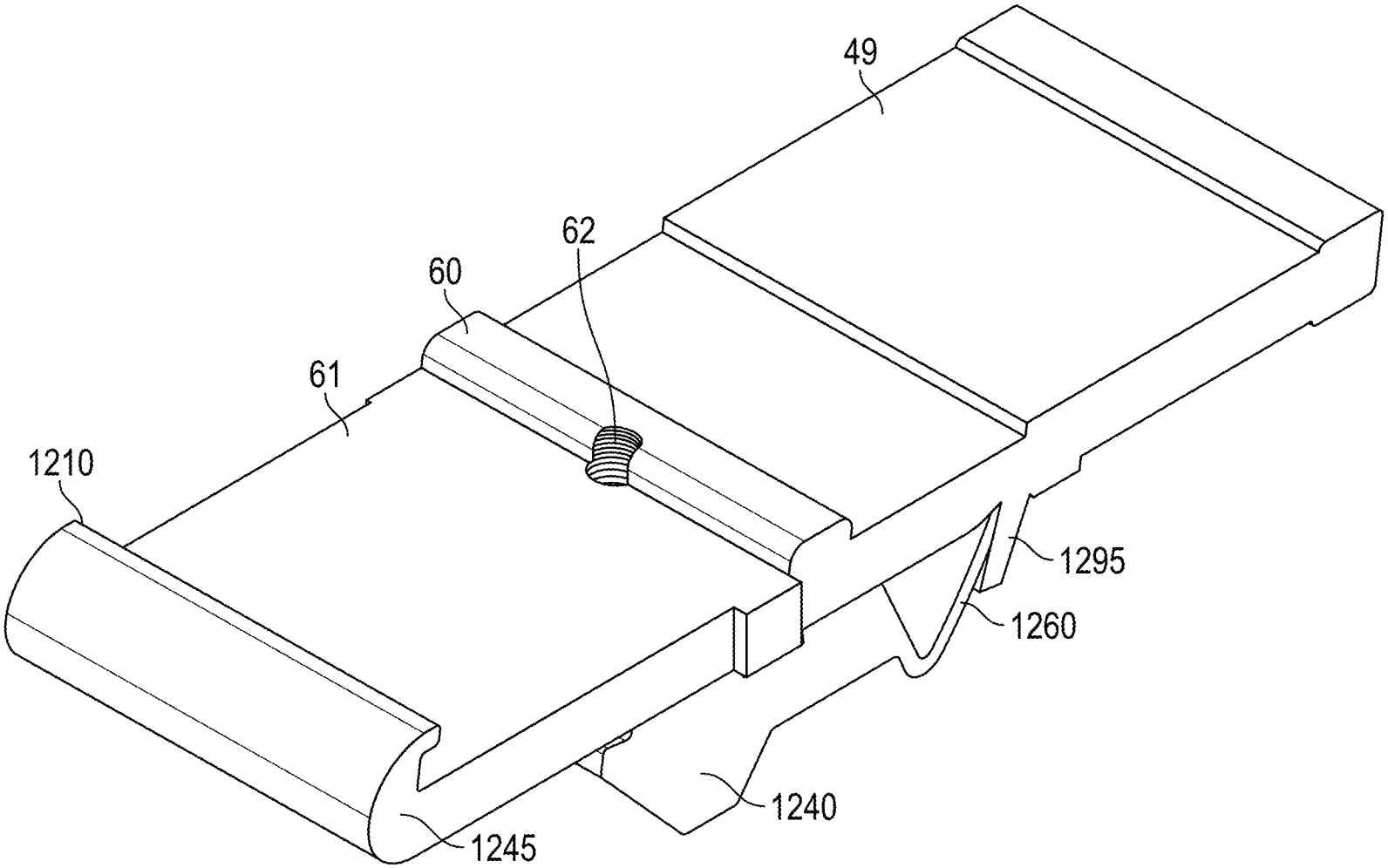
FIG. 8B depicts a perspective view of the bracket clip of FIG. 8A.

Turning to FIGS. 6E, 8A and 8B, the channel rod clip 46 connects to channel rod 2 in the same manner as ceiling bracket 200. Channel rod clip 46 is similar in structure to ceiling mount 200. Similar elements therefore have the same reference numbers used when discussing ceiling mount 200, but with the prefix "1" added. The channel rod clip 46 comprises an extension 49 adapted to be slidably received within housing 44. The extension 49 can be retained within the housing 44 using, for example, a screw, pin, etc. extending through the hole 52. The channel rod clip 46 may optionally include a rib 60, which is provided to engage the interior surface of the housing 44. The channel rod clip 46 comprises a main support arm 61 having a hole 62 extending therethrough, similarly to the lower arm 290 of ceiling bracket 200. The hole 62 is adapted to receive a fastening means such as a screw that extends through hole 1241. The fastening means can be accessed via hole 51, shown in FIG. 6E. The remaining components function in substantially the same manner as discussed with respect to FIGS. 2A, 2B and 7.

As noted above, after the system has been assembled and the wall plate 30 has been screwed into a wall, via apertures 32, the car 20 is able to move vertically, along with the faceplate 42, with respect to wall plate 30. This, in turn, vertically moves the entire suspension assembly with respect to wall plate 30. Such vertical movement can be achieved via a user extending a tool such as a screwdriver through faceplate opening 48 into opening 36, and subsequently rotating the retaining pin 23 in a given direction.

It will be appreciated that the vertically adjustable wall mount and faceplate can be oriented such that the extension 35 is accessible from the top of the faceplate depending on the preferences of the user. The vertically adjustable wall mount and faceplate can also be oriented such that the extension 35 is accessible from the sides of the faceplate, thereby facilitating horizontal adjustment of the wall mount in a plane parallel to the wall. In such case, the rotational movement of the pin 23 would still result in vertical translation of the car 20, but the car would be provided with threading on a side thereof, for example. It will be appreciated that other known mechanisms can be used to vertically move the car 20 with respect to the wall plate 30.

Although the above description includes reference to certain specific embodiments, various modifications thereof will be apparent to those skilled in the art. Any examples provided herein are included solely for the purpose of illustration and are not intended to be limiting in any way. Any drawings provided herein are solely for the purpose of illustrating various aspects of the description and are not intended to be drawn to scale or to be limiting in any way. The scope of the claims appended hereto should not be limited by the preferred embodiments set forth in the above description but should be given the broadest interpretation consistent with the present specification as a whole. The disclosures of all prior art recited herein are incorporated herein by reference in their entirety.

We claim:

1. A wall mount assembly for a curtain suspension system, the wall mount assembly comprising:

a wall plate, adapted to be secured to a wall, and having a vertically extending track defined by two opposed walls and a base, the track having a longitudinal axis;

an adjusting pin having a threaded first portion and a second portion, the second portion extending through the base, the adjusting pin having a longitudinal axis generally parallel to the longitudinal axis of the track and wherein the adjusting pin is rotatable about its longitudinal axis with respect to the wall plate; and, a car adapted to be slidably received in the track, the car comprising a single body, with the body having a threaded aperture for receiving and cooperating with the threaded first portion of the adjusting pin, the car further comprising a means for engaging a component of the curtain suspension system and to vertically raise or lower the component of the curtain suspension system as the car is moved in the track;

wherein the opposed walls of the wall plate each include a flange, wherein the flanges extend towards each other for further defining the track and wherein the body of the car includes grooves for receiving the flanges.

2. The wall mount assembly of claim 1, wherein the second portion of the adjusting pin includes an end adapted to receive a tool for rotating the adjusting pin.

3. The wall mount assembly of claim 1, wherein the track includes at least one means for limiting the sliding movement of the car with respect to the wall plate.

4. A curtain suspension system comprising:

a wall mount assembly according to claim 1; and, a support means comprising a first end, for connecting to the car of the wall mount assembly, and a second end, for connecting to a curtain support rod.

5. The curtain suspension system of claim 4, further comprising a faceplate provided over the wall plate, wherein the faceplate includes aperture for accessing the adjusting pin.

6. The curtain suspension system of claim 4, wherein the support means comprises:

a connecting member adapted to be connected to the car;

an elongate housing having a first end for securing to the connecting member and a second end;

a clip having a first end, adapted to be connected to the second end of the housing, and a second end, adapted to be connected to a curtain rod.

7. The curtain suspension system of claim 6, wherein the means for engaging a component comprises a protrusion provided on the car, the protrusion being adapted to be engaged within an aperture provided on the connecting member.

8. The curtain suspension system of claim 6, further comprising a means for securing the clip to the housing.

9. A curtain suspension system comprising:

a wall mount assembly according to claim 1; and, a curtain rod comprising a generally elongate hollow body having a front face, a rear face, and a bottom surface, wherein:

the front face comprises a façade, a top end, and a bottom end, wherein the top end of the front face is provided with a first hook;

the rear face comprises a first longitudinally extending channel comprising the first hook and a longitudinally extending flange;

the bottom surface comprises second longitudinally channel adapted to slidably receive curtain suspension hooks;

a clip adapted to be secured to the wall mount assembly and having a connecting end for connecting to the curtain rod, the connecting end including a second hook and a recess;

whereby, when in use, the second hook of the clip engages the first hook of the curtain rod and the flange of the curtain rod is received within the recess of the clip.

10. The curtain suspension system of claim 9, wherein the first channel of the curtain rod further includes a stop for abutting against the connecting end of the clip.

11. The curtain suspension system of claim 9, wherein the curtain rod is provided in segments and wherein ends of the segments comprise connection means for connecting to adjacent curtain rod segments.

12. The curtain suspension system of claim 9, wherein the clip includes a locking means for securing the curtain rod to the clip.

13. The curtain suspension system of claim 12, wherein the recess is formed between a surface of the clip and the locking means.

14. The curtain suspension system of claim 12, wherein the locking means is biased in a direction towards the curtain rod.

* * * * *